US009539180B2

(12) United States Patent
Ridley

(10) Patent No.: US 9,539,180 B2
(45) Date of Patent: Jan. 10, 2017

(54) BOTTLE FEEDING SYSTEM

(71) Applicant: Robert J. Ridley, Maryville, TN (US)

(72) Inventor: Robert J. Ridley, Maryville, TN (US)

( * ) Notice: Subject to any disclaimer, the term of this patent is extended or adjusted under 35 U.S.C. 154(b) by 0 days.

(21) Appl. No.: 14/427,388

(22) PCT Filed: Jul. 23, 2014

(86) PCT No.: PCT/US2014/047737

§ 371 (c)(1),
(2) Date: Mar. 11, 2015

(87) PCT Pub. No.: WO2015/013362

PCT Pub. Date: Jan. 29, 2015

(65) Prior Publication Data

US 2016/0193116 A1 Jul. 7, 2016

Related U.S. Application Data

(60) Provisional application No. 61/858,392, filed on Jul. 25, 2013.

(51) Int. Cl.

| | |
|---|---|
| ***A61J 11/00*** | (2006.01) |
| ***A61J 9/00*** | (2006.01) |
| ***A61J 9/08*** | (2006.01) |

(52) U.S. Cl.

CPC ..... *A61J 11/002* (2013.01); *A61J 9/001* (2013.01); *A61J 9/085* (2013.01); *A61J 11/0085* (2013.01)

(58) Field of Classification Search

CPC ..... A61J 9/001; A61J 11/001; A61J 11/002

USPC ..... 215/11.1, 11.3, 11.4; 222/386; 426/115; 220/717

See application file for complete search history.

(56) References Cited

U.S. PATENT DOCUMENTS

| | | | | |
|---|---|---|---|---|
| 2,727,659 | A | 12/1955 | Nyden | |
| 2,907,485 | A * | 10/1959 | Lunden | A61J 9/001 215/11.1 |
| 3,093,256 | A * | 6/1963 | Woodbury, Jr. | A61J 9/00 215/11.1 |
| 3,206,054 | A * | 9/1965 | Militello | A61J 9/001 137/533.17 |
| 3,214,069 | A | 10/1965 | Dike | |
| 3,672,547 | A | 6/1972 | Kozlowski | |
| 4,010,861 | A * | 3/1977 | Welten | A61J 9/04 215/11.5 |
| 4,066,191 | A | 1/1978 | Coleman | |

(Continued)

FOREIGN PATENT DOCUMENTS

| | | |
|---|---|---|
| EP | 00009460 | 4/1980 |
| WO | 2007000577 | 1/2007 |

(Continued)

OTHER PUBLICATIONS

Pura Kiki Soft Spouts, Pura Stainless, https://www.purastainless.com/purchase/kiki-spouts/, Accessed Oct. 8, 2012.

(Continued)

*Primary Examiner* — Sue A Weaver

(74) *Attorney, Agent, or Firm* — Luedeka Neely Group, P.C.

(57) ABSTRACT

A feeding system for use with both liquids and semi-solids, having a bottle and a spout mountable on the bottle, the spout having an enlarged opening that is suitably sized to accommodate the easy flow of semi-solid foods.

9 Claims, 7 Drawing Sheets

(56) References Cited

U.S. PATENT DOCUMENTS

| | | | | | |
|---|---|---|---|---|---|
| 4,091,965 | A | | 5/1978 | Gebhard | |
| 4,154,366 | A | | 5/1979 | Acres | |
| 4,339,046 | A | | 7/1982 | Coen | |
| 4,353,489 | A | | 10/1982 | Arnold et al. | |
| 4,572,386 | A | | 2/1986 | Marcus | |
| 4,579,257 | A | | 4/1986 | Brandlein | |
| 4,669,124 | A | | 5/1987 | Kimura | |
| 4,739,906 | A | | 4/1988 | LoTurco | |
| 4,949,884 | A | | 8/1990 | Dahl | |
| 5,234,117 | A | * | 8/1993 | Garvin | A47G 21/18 215/11.1 |
| 5,275,311 | A | | 1/1994 | Piarrat | |
| D350,482 | S | | 9/1994 | Hu et al. | |
| D357,184 | S | | 4/1995 | Keith et al. | |
| 5,462,101 | A | | 10/1995 | Mouchmouchian | |
| 5,474,028 | A | * | 12/1995 | Larson | A01K 9/005 119/71 |
| 5,474,212 | A | | 12/1995 | Ichikawa et al. | |
| 5,547,091 | A | | 8/1996 | Neveras et al. | |
| D374,399 | S | | 10/1996 | Neveras et al. | |
| 5,682,931 | A | | 11/1997 | Mouchmouchian | |
| D398,233 | S | | 9/1998 | Wood | |
| 5,799,808 | A | * | 9/1998 | Oh | A61J 9/00 215/11.1 |
| 6,142,344 | A | | 11/2000 | Kai | |
| D438,799 | S | | 3/2001 | Anderson | |
| D440,494 | S | | 4/2001 | Sagel et al. | |
| D450,585 | S | | 11/2001 | Kamata | |
| 6,612,428 | B1 | | 9/2003 | Segovia, Jr. et al. | |
| 6,688,500 | B1 | | 2/2004 | Cheng | |
| 6,945,394 | B2 | | 9/2005 | Segovia, Jr. et al. | |
| D551,075 | S | | 9/2007 | Puller | |
| 7,506,754 | B2 | | 3/2009 | Segovia, Jr. et al. | |
| 7,959,045 | B2 | | 6/2011 | Kuge et al. | |
| 8,020,303 | B1 | | 9/2011 | Marsh | |
| 8,083,102 | B2 | | 12/2011 | Murray | |
| 2006/0081552 | A1 | * | 4/2006 | Jiang | A61J 9/006 215/11.1 |
| 2008/0073306 | A1 | | 3/2008 | Arel et al. | |
| 2009/0120894 | A1 | | 5/2009 | Kario et al. | |
| 2010/0196556 | A1 | | 8/2010 | Wheeler | |
| 2014/0097211 | A1 | | 4/2014 | Oates, II et al. | |

FOREIGN PATENT DOCUMENTS

| | | |
|---|---|---|
| WO | 2010038047 | 4/2010 |
| WO | 2012015883 | 2/2012 |

OTHER PUBLICATIONS

International Search Report for PCT/US2014/047737, Mailed Jan. 29, 2015 (16 pages).

* cited by examiner

BOTTLE FEEDING SYSTEM

CROSS-REFERENCE TO RELATED APPLICATION(S)

This application is a national phase entry of PCT International application number 371 PCT/US2014/047737, filed Jul. 23, 2014, which claims the benefit of U.S. Provisional Application No. 61/858,392, filed Jul. 25, 2013, entitled "Baby Bottle Feeding System."

FIELD

This disclosure relates to bottles or other similar rigid containers. More particularly, the disclosure relates to a bottle feeding system that includes a nipple having an enlarged opening suitably sized for semi-solid foods and either a liner or an integrated piston to hold the liquids or semi solids.

BACKGROUND AND SUMMARY

Bottles provide a simple and convenient method for feeding both adults and babies. However, bottles are not well suited for semi-solid foods. Accordingly, there is a need for a feeding system that provides a simple and convenient way for eating semi-solid foods.

The present disclosure relates to a bottle-feeding system having an enlarged opening that is well suited for semi-solid foods. The system generally includes a rigid container or housing having an upper opening defined by an upper rim that provides access to an interior of the container. A volume compensator is inserted into the interior to assist in storing liquids or semisolids poured into the container. For example, in certain embodiments, the volume compensator may be a food grade bottle liner. The liner has a container portion configured for insertion in to the interior and a lip portion configured to engage the upper rim.

The spout has an enlarged outlet that is sized for semi-solid food. The spout includes a one-way valve having a lower ring portion that surrounds a plurality of flaps that form an opening and are configured to move between an open position and a closed position. The spout also includes a first lid portion removably engaging a top surface of the lower ring portion and having a first orifice in concentric alignment with the valve opening. The flaps extend through the first orifice. Additionally, a retainer ring having an inwardly extending retainer portion is configured to directly contact the lid portion. A first connection member and a second clamping member disposed on the container are configured to mate together to clamp the container, bottle liner and spout together.

In an alternative embodiment, the volume compensator includes a piston having a deformable body that is configured for insertion into the container. The piston contacts and forms a leak resistant seal with an inside surface of the container such that liquids and semi solids may be poured directly onto the piston. A frictional force between the body and the inside surface may be fitted to hold the piston in place. At other times, the piston may be configured to slide upwards and downwards within the container. For example, the piston may slide upwards within the container when suction is applied and then slide downwards when suction is removed. However, preferably a one way valve prevents the piston from sliding downwards once suction is removed. Applying a suction force to a top surface of the piston reduces the frictional force such that the piston is permitted to move within the container.

In addition to infants and small children, this bottle system could be used by adults with special needs. For example, adults having diminished fine motor skills or who are otherwise prevented from feeding themselves normally could use this bottle system.

BRIEF DESCRIPTION OF THE DRAWINGS

Further advantages of the disclosure are apparent by reference to the detailed description when considered in conjunction with the figures, which are not to scale so as to more clearly show the details, wherein like reference numbers indicate like elements throughout the several views, and wherein.

DETAILED DESCRIPTION

Figure 1:
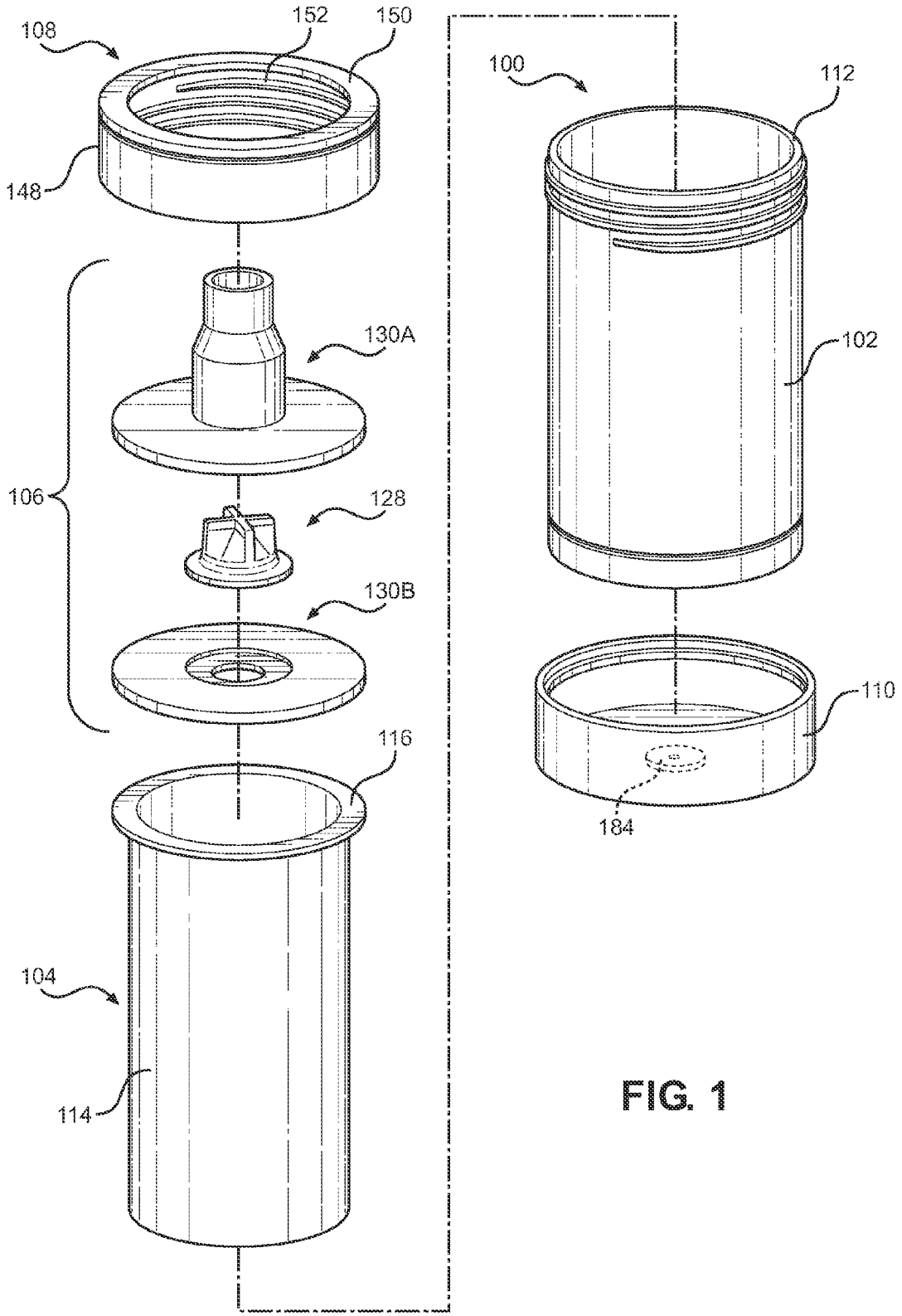
FIG. 1 shows an exploded view of a bottle having a food spout according to the present disclosure.

The present disclosure relates to a bottle system that can accommodate liquids and semi-solid foods. With reference now to the figures, in which like reference characters designate like or corresponding parts throughout the several views and, in particular, to FIG. 1, there is provided a bottle feeding system according to a first major embodiment, which is generally referred to herein as a bottle 100. The bottle 100 includes a bottle housing, which may also be referred to herein as a rigid container 102, a volume compensator, such as a food grade bottle liner 104, designed to hold liquids or semi-solids inserted into an interior of the bottle, a food spout 106 having an enlarged opening suitable for semi-solids, a rigid retention member 108 threaded and secured to the bottle, and an optional cover 110 that may be mounted to the top or bottom of the bottle 100.

The container 102 has an upper opening that is defined by an upper rim 112 that provides access to an interior of the container 102. The bottom of the container 102 may be closed or may be open. Having an open bottom and an open top would facilitate access and cleaning. However, a recurring problem in feeding children from a bottle having an open bottom container is that the child may tamper with the filled liner and cause food or liquids to spew from the bottle's spout. Therefore, in alternative embodiments, the bottom of the container 102 may be enclosed to assist in preventing spills and waste since the liner would be inaccessible.

The bottle liner 104 has a container portion 114 and a lip portion 116. The container portion 114 of the bottle liner 104 is inserted into the container 102 via the upper rim 112. When the container portion 114 is inserted into the interior of the container 102, the lip portion 116 is designed to rest on the upper rim 112 in order to maintain the liner 104 in place.

Figure 2:
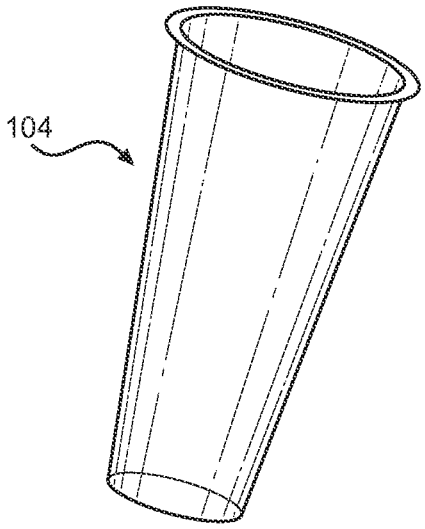
FIGS. 2-4 show perspective views of various liners.

The precise size and configuration of the container 102 may change according to the size and type of bottle liner 104 being used. For example, the liner 104 shown in FIG. 2 is tapered and has a wider top and a narrower bottom. A correspondingly tapered container could be used in connection with this particular liner 104. Alternatively, taller or shorter liners may be provided for taller or shorter containers.

Figure 3:
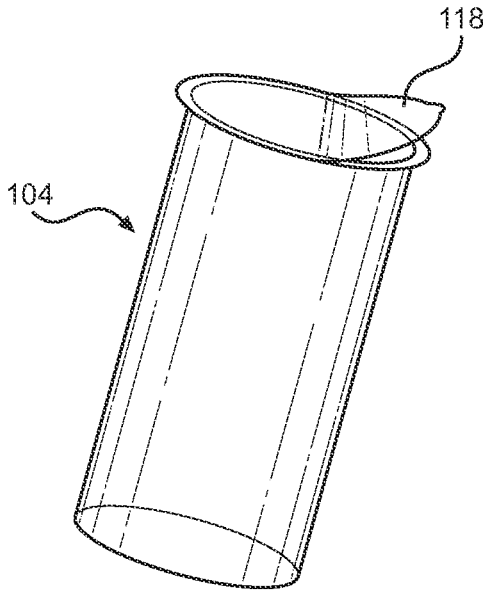

FIG. 3 illustrates the liner 104 having a peel off top 118. This liner 104 could be pre-filled with a quantity of liquid or semi-solids and sealed with the peel off top 118 that is removably mounted to the lip portion 116. Customers would have the option of purchasing one or more of the pre-filled liners 104 to open and use in the bottle 100 when desired. One advantage of the liners 104 having peel off tops 118 is that they could be sold in stores at the appropriate temperature and ready for immediately use. Another advantage of the liners 104 could be a single-use and easily disposable. A third advantage is that the disposable prefilled liners 104 would obviate the need for the cleaning and sterilization steps that are required by reusable liners. This would be particularly advantageous in hospitals and nurseries to prevent the spread of germs.

Figure 4:
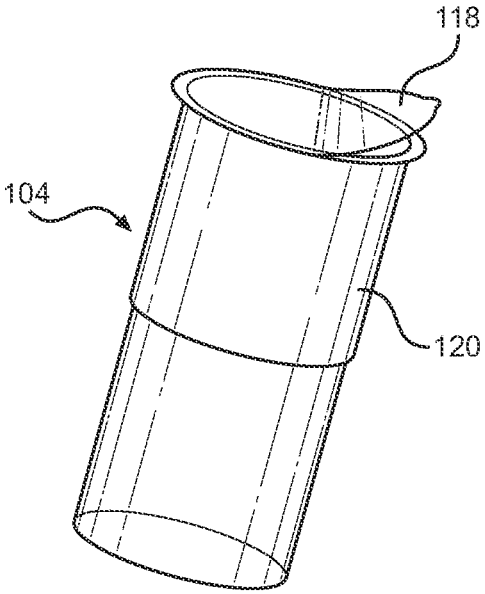

FIG. 4 illustrates a second type of pre-filled liner 104 that includes a reinforced section 120 that is thicker than the un-reinforced sections of the liner. The reinforced section 120 assists in preventing the spout 106 from becoming blocked if the liner 104 collapses in on itself during use. As the user feeds and food is removed from the liner 104, the liner will tend to collapse inwards, which may cause the spout 106 to become blocked. Placing the reinforced liner section 120 along the top of the container portion will tend to prevent the collapsing liner 104 from obscuring the spout 106. In certain embodiments, the liner 104 may include a plurality of separate and discreet reinforced sections 120 that are spaced along the length of the container section 114.

In other embodiments, a separate liner spreader may be used to prevent the aforementioned problems associated with liner collapse. As with the reinforced liner sections 120 described above, the liner spreader assists in preventing the spout 106 from becoming clogged by holding the collapsing liner 104 away from the spout. The liner spreader preferably includes a cylindrical tube having an open top and bottom and, in certain embodiments, may include a lip that surrounds the top edge of the cylindrical tube. Referring again to FIG. 1, after the liner 104 is inserted into the container 102, the liner spreader may be inserted into the liner such that the inside surface of the liner faces the outside surface of the cylindrical tube. The lip of the liner spreader rests on top of the lip 116 of the liner 104 and the cylindrical tube extends downwards from the upper rim 112 of the container 102. The liner spreader holds the liner 104 away from the spout 106 and prevents clogging. Alternatively, the liner spreader may be mated with an inside bottom surface of the retention member 108 such that the liner spreader is automatically inserted into the liner 104 at the same time that the retention member is fixed to the container 102.

Once the liner 104 has been inserted into the container 102, the food spout 106 is also placed on the upper rim 112 so that it covers the liner and the upper opening of the container. The spout 106 may be formed from one or more components using a combination of pliable or rigid materials, including, for example, silicone, rubber, plastic or other similar materials. Preferably, these materials are food grade materials. In certain embodiments, the spout includes a one-way valve 128 that works cooperatively with a lid portion 130, including a first lid portion 130A and a second lid portion 130B. The lid portion 130 encircles the one-way valve 128 and is sized to cover the upper opening of the bottle 100 and preferably provides a leak resistant seal with the container 102 and liner 104. The lid portion 130 may be constructed entirely from a rigid material such as a hard plastic. In other embodiments, at least a bottom surface of the lid portion 130 is constructed from food grade rubber or silicone or similar material. In yet other embodiments, the entire lid portion 130 may be constructed from food grade rubber or silicone or similar material.

Figure 5:
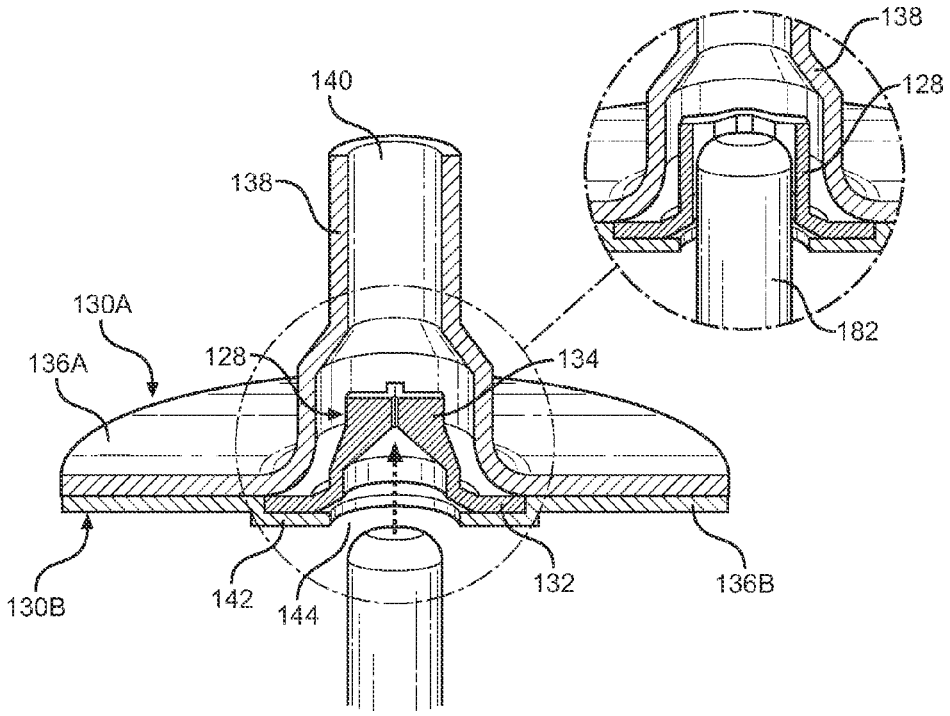
FIG. 5 is a perspective view showing a food spout having a one way valve shown in a closed and an open position.

With reference to FIG. 5, in one embodiment, the first lid portion 130A and second lid portion 130B that are placed above and below the one-way valve 128, respectively, in order to sandwich the one-way valve 128 between them. When the valve 106 is sandwiched between the lid portions 130A, 130B, the lower surface of the first lid portion 130A rests on both the top surface of the second lid portion 130B as well as on a section of the valve 128. This configuration advantageously secures the valve 106 in place and prevents it from moving. In particular, the one-way valve 128 includes a lower ring portion 132 that surrounds the valve and a plurality of flaps 134 that are located above and are encircled by the lower ring portion and that are designed to open and close to form an opening. The detail view of FIG. 5 shows the valve 128 in the open position. In this particular figure, the valve 128 is being opened by a plunger, which is discussed in detail below. However, it may also be appreciated that the pressure of liquids or semi-solids may also cause the valve 128 to open. Preferably the first lid portion 130A rests on the lower ring portion 132 to secure it in place.

The flaps 134 provide a one-way seal, allowing liquids and semi-solids to pass through in only one direction. The flaps 134 move back and forth between an open position, when liquids and semi-solids flow out through the valve, and a closed position, where the flow ceases. In one example, the valve 128 shown in FIG. 5 is a cross-slit valve, which includes plurality of movable flaps that each form an approximately 90° angle and that are arranged to form a cross-shaped seal in the closed position. An advantage of using a cross-slit valve is higher flow capacity. However, other one-way valve types, having a fewer or greater number flaps, such as a duckbill valve, may also be used.

The first lid portion 130A consists of a flat disc-shaped first flange 136A and a spout tip 138 having an enlarged outlet 140 at the top that is sized for semi-solids. The spout tip 138 is sized for insertion into a mouth of a user. The second lid portion 130B consists of a flat disc-shaped second flange 136B that is configured to rest on the upper rim 112 of the container 102. The second flange 136B has a shallow circular indentation 142 located in its center. The height and outside diameter of lower ring portion 132 of the one-way valve 128 are sized so that it fits into the circular indentation 142 and the top of the lower ring portion is flush with the top surface of the second flange 136B and only the flaps 134 extend above the second flange. Additionally, an orifice 144 is located within the circular indentation 142.

The orifice 144 is approximately the same size as the opening formed when the flaps 134 of the one-way valve 128 is in the open position. Preferably, the bottom of the spout tip 138 is slightly larger than the orifice 144, which provides a small amount of space where the flaps 134 are located when the valve 128 is the open position. In certain embodiments, the outlet 140 is substantially the same size as the orifice 144. In certain embodiments, the spout tip 138 is tapered so that the orifice 144 is larger than the outlet 140. Tapering the spout tip 138 in this manner allows the user to easily insert the spout tip 138 into its mouth, whereas a larger spout might be too large to fit comfortably into the user's mouth. A second advantage is that tapering the spout tip 138 causes pressure to build as semi-solid food flows through, which assists in forcing the food through the spout and into the user's mouth. This design is particularly beneficial for thicker foods, such as oatmeal, which might otherwise become lodged or stuck in a non-tapered spout tip 138.

Returning to FIG. 1, the container 102, liner 104 and spout 106 may be secured together to form a leak resistant seal by the retention member 108, which consists of a retaining ring 148 having a retaining portion 150 that extends inwards from the retainer ring. The retaining portion 150 presses down on the spout 106 to secure it to the top of the container 102. In certain embodiments, an inner surface of a retainer ring 148 is provided with threads 152 that mate with corresponding threads located on the exterior of the container 102 near the upper rim 112. In other embodiments, corresponding snaps provided on the retainer ring and container may be mated together.

Figure 6:
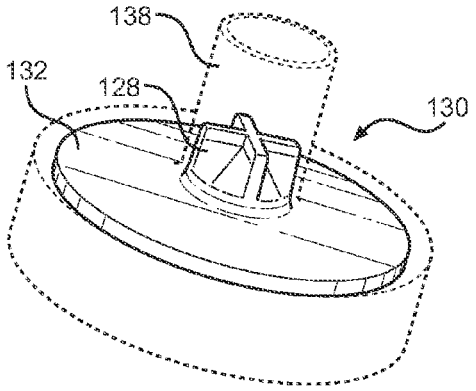
FIGS. 6 and 7 show perspective views of embodiments of one-piece spouts and lids.
Figure 7:
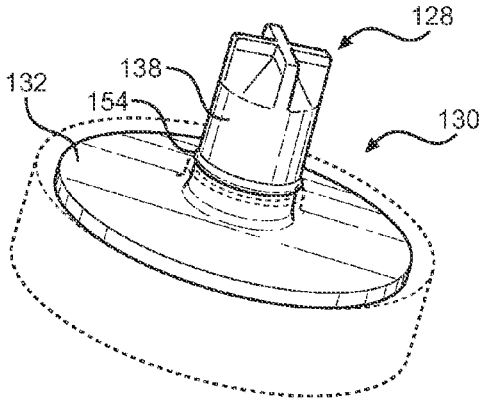

With reference to FIG. 6, certain embodiments of the one-way valve 128 have an enlarged lower ring portion 132 that is sized to rest directly on the upper rim of the container. A single lid portion 130 is placed over the valve 128 and then the retaining ring is secured to the container. In certain embodiments, the lid portion 130 itself may include a spout tip 138 that extends upwards from the lid portion 130. The flaps are inserted through an opening in the lid portion 130 and into the spout tip 138. The retention ring is joined to an outer edge of the lid portion 130. Alternatively, as shown in FIG. 7, the one-way valve 128 may include a spout tip 138. In this embodiment, the single lid portion 130 includes has an opening and the flaps 134 and spout tip 138 are inserted through the opening. To form a secure seal, the spout tip 138 may include a ridge 154 that is configured to rest snugly against the top edge of the opening to secure the valve in place.

Figure 11:
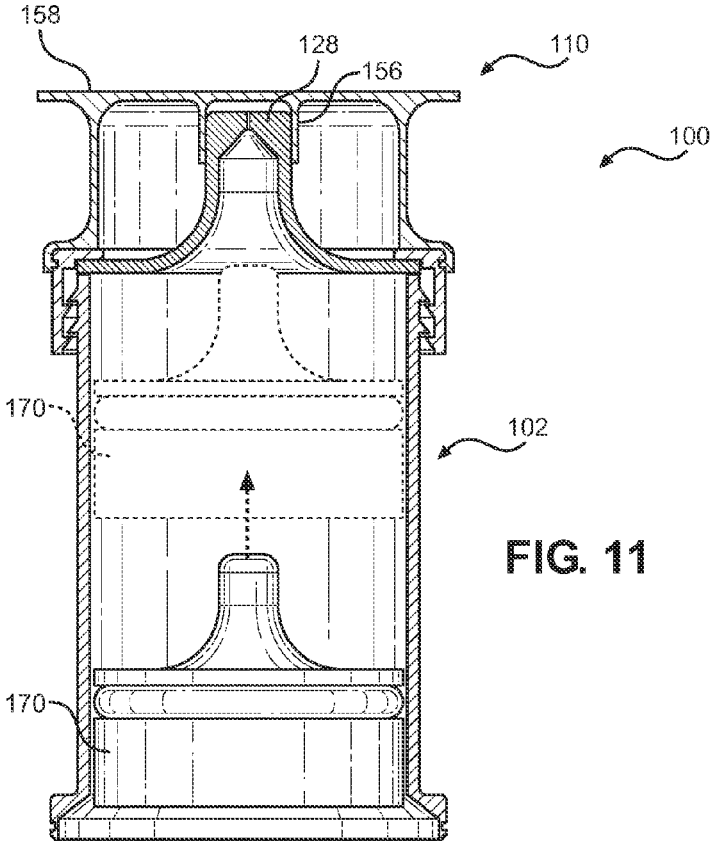
FIG. 11 is a side elevation view showing a bottle having a cap attached to the bottle with a threaded connection and a piston.

With reference to FIG. 11, the bottle 100 may optionally include a cover 110 that may be removably secured to the top or bottom of the container 102. The cover may include a shield 156 on an inside surface of the cover configured to protect the valve 128. Additionally, when a liner is in use, placing the cover 110 on the bottom of the container 102 would assist in preventing tampering with the liner 104. The connection members may include, for example, threads or snaps. The cover 110 may include a flat 158 that enables the bottle 100 to be securely placed on flat surfaces.

The cover 110 preferably includes first connection members, which are configured to removably mount to corresponding second connection members formed on the bottom of the container 102 or third connection members formed on the top of the container. The snap connection may be achieved, for example, by providing a ridge located on a lower inside or outside surface of the cover 110 that mates with a corresponding ridge located on the outer or inside edge of the retention member 108 and on a lower outer edge of the container 102. Alternatively, the cover 110 may be connected to the top or bottom of the bottle via a threaded connection. For example, threads may be placed along the inside or outside surface of the cover 110 and corresponding threads may be placed on the outside or inside surface of the retention member 108 and an outside lower surface of the container 102. An advantage of a threaded connection is that it may provide a more secure, tamper-proof connection and may also prevent accidentally disconnecting the cover from the bottle.

Figure 8:
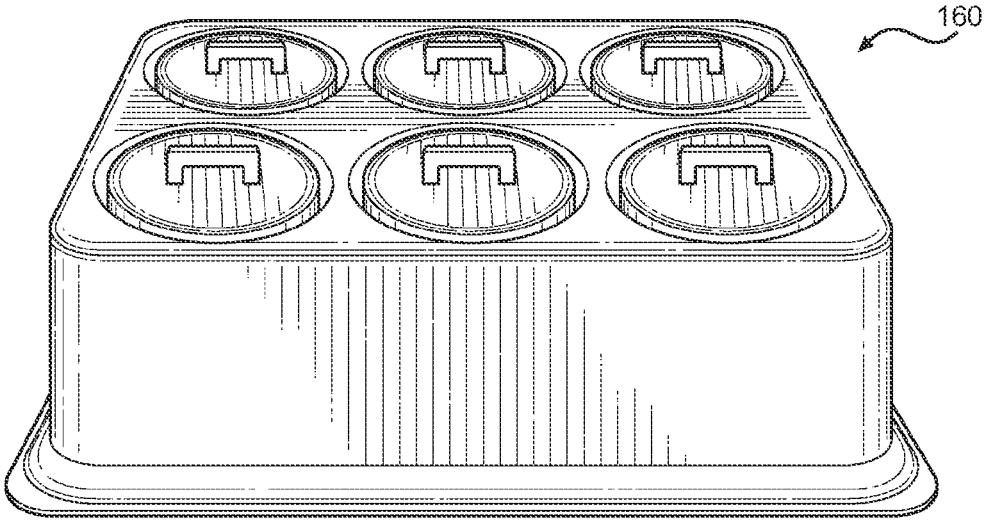
FIG. 8 is a perspective view of a bottle carrier.
Figure 9:
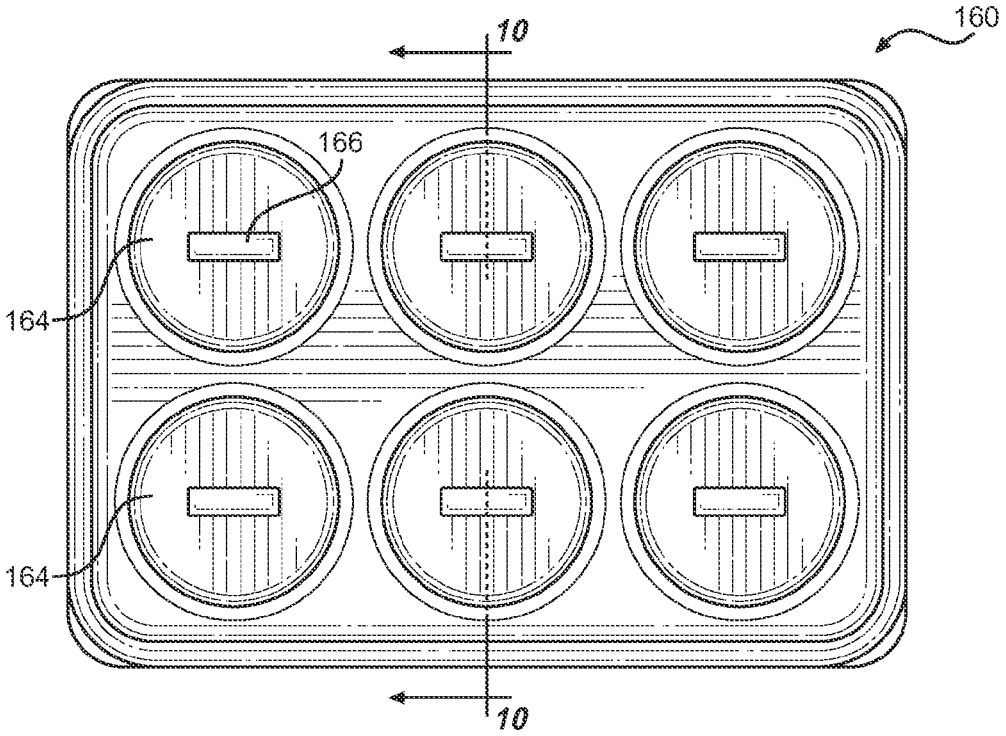
FIG. 9 is a top view of the bottle carrier shown in FIG. 8.
Figure 10:
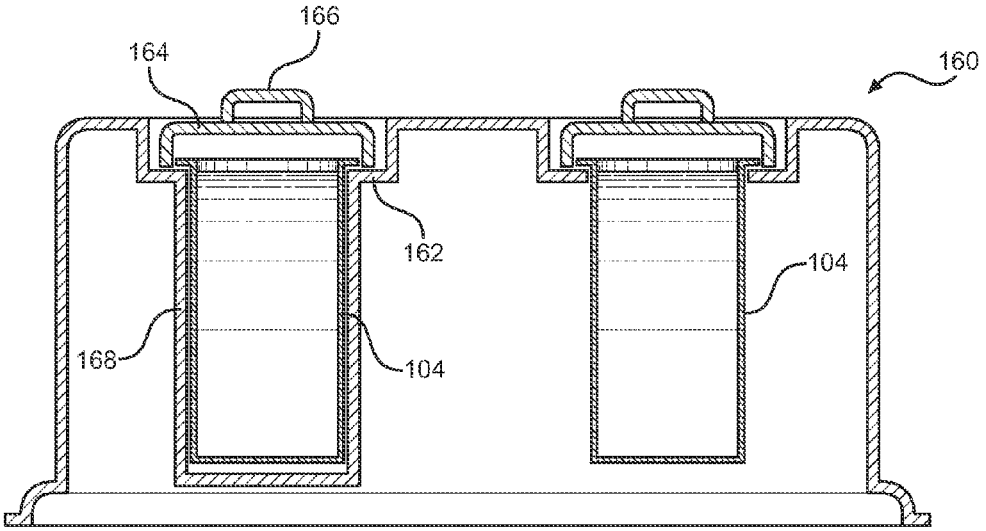
FIG. 10 show a sectional view of the of the bottle carrier of FIG. 9.

With reference now to FIGS. 8-10, the bottle 100 may also include an optional storage tray 160 for holding and storing individual bottle liners 104 that have been prefilled with food or liquids, including sealed prefilled liners, as discussed above, or traditional unsealed liners that have been filled by a user. Placing one or more liners 104 into the tray 160 allows them to then be conveniently stored and stacked in refrigerators or freezers, for example, for short or long term storage.

The storage tray 160 includes a tray body and one or more cutouts 162 that are sized to receive one liner 104 each. The outwardly extending lip of the liner 104 rests on the edge of the cutout 162 and the container portion extends downwards into the tray 160. Next, a tray cover 164 may be placed over the entire tray 160 covering all of the cutouts 160 and liners 104. The tray cover 164 preferably forms a leak-proof seal such that no food or liquids can leak from the storage tray 160. In an alternate embodiment, separate tray covers 164 may cover each cutout 162. The tray covers 164 may also include a handle 166 that allows for easy placement and removal of the covers into the cutouts 160. In certain embodiments, each cutout 160 has a corresponding well 168, including at least one wall and a bottom, which extends into the storage tray 160 and is configured to surround the inserted liners 104. In other embodiments, no well is provided and the liner 104 is simply suspended within the tray 160.

In a second major embodiment, as shown in FIG. 11, a piston 170 may be used in place of a liner 104. The piston 170 comprises a cylindrical body that may be made from a rigid material, such as plastic, or a pliable material. The piston 170 is placed into the open bottom of the container 102 and forms a leak-proof seal with the inside wall of the container so that food or liquids may be poured into the container directly on top of the piston. Sidewalls of the piston 170 are sufficiently tall to prevent it from rotating within container 102. To reduce the weight of the piston 170, the inside and bottom surface of the piston bottom may be hollowed or shelled. In certain embodiments, the piston 170 may be held in place by friction between the sides walls of the piston and the inside walls of the container 102. The piston 170 is configured to move from the bottom opening of the container to the upper opening of the container.

A sealed volume, where liquid or semi-solids may be stored, is formed in the bottle 100 between the tops of the piston 170, the container 102 walls and the bottom of the spout 106. As the user sucks food through the spout, a vacuum is created in this sealed volume and a suction force is applied to the top of the piston 170. In certain embodiments, this suction force causes the top portion of the piston 170 to be deformed and to stretch towards the spout 106, which causes the piston to become slightly narrowed and relieves some of the pressure between sidewalls of the container 102 and the piston 170. Alternatively, the piston may be more rigid such that deformation does not occur. In either case, once the suction force acting on top of the piston is greater than the frictional force between the piston and the walls of the container, the piston 170 moves freely within the container 102. It is then drawn towards the spout 106 through continued suction. When suction is released, the deformable piston 170 returns to its original shape, the frictional force increases, and movement of the piston stops. When the piston 170 returns to its original shape (i.e., from a stretched condition to an un-stretched condition), a slight vacuum pressure is created inside the bottle due to the retraction of the piston. This may cause any food or liquid that is near the outlet to be drawn back down the spout tip.

Figure 12:
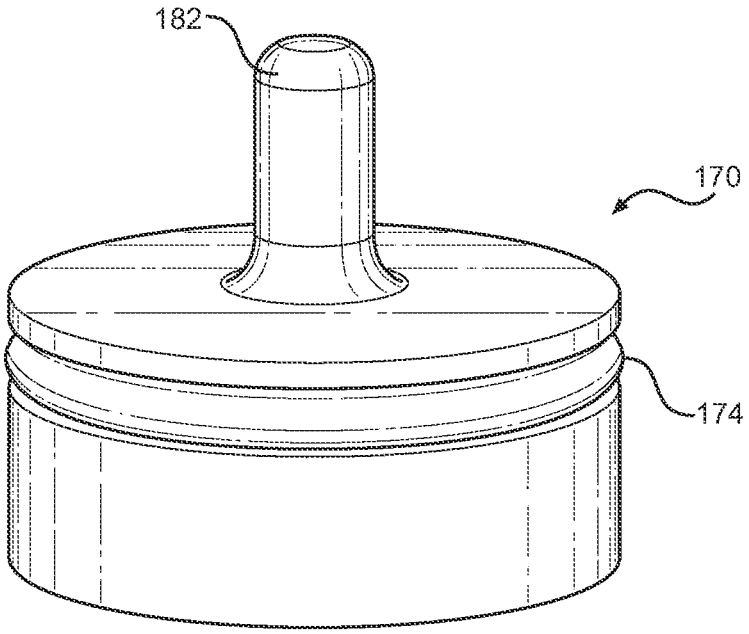
FIGS. 12 and 13 are perspective views showing various embodiments of pistons.
Figure 13:
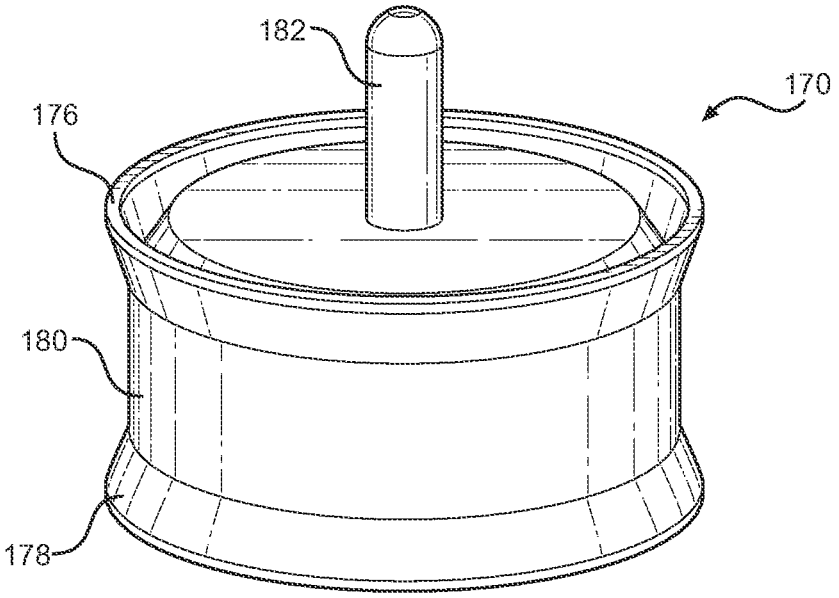

As shown in FIG. 12, the piston 170 may include an O-ring 174 that is placed into a channel in the side of the piston. Alternatively, as shown in FIG. 13, a one-piece piston has a tapered top edge 176, a tapered bottom edge 178, and a recessed middle 180. The top of the piston 170 may be flat or curved. Alternatively, an elongate plunger 182 may extend upwards from the top of the piston 170. As shown in the detail view of FIG. 5, as the piston 170 is drawn up to the very top of the container, the plunger 182 is pulled through the valve 128 and into the spout tip 138, which forces any remaining food out through the outlet.

Referring again to FIG. 11, from the discussion above, it may be appreciated that as the piston 170 rises in the container 102, the volume of space within the container under the piston (lower volume) increases and the volume over the piston (upper volume) decreases. When the bottom of the container 102 is open, air easily fills this lower volume. However, if the bottom is enclosed using a cover 110, air may not be able to fill the lower volume. In that instance, drawing the piston 170 upwards using the above-described suction force would be difficult because doing so would create a vacuum in the lower volume as well. Furthermore, drawing food through the spout would be difficult due to the limited movement of the piston 170 whether a one-way valve 128 were present or not.

By providing an inlet for air to enter the lower volume such that no vacuum is created in the lower volume when suction is applied to upper volume, the piston 170 could again move freely within the container 102. If the air inlet were a one-way inlet so that air entering the lower volume is trapped, the piston 170 would be unlikely to move downwards in the container 102. Accordingly, in certain embodiments, the one-way air valve 128 in the spout 106 may be eliminated and the bottle may include a cover 110 that forms an airtight seal when placed on the bottom portion of the container 102. As shown in FIG. 1, a one-way air inlet 184 disposed in the cover 110 allows the lower volume to be filled with air as the piston 170 is drawn upwards and prevents the piston from traveling downward in the container.

Figure 14:
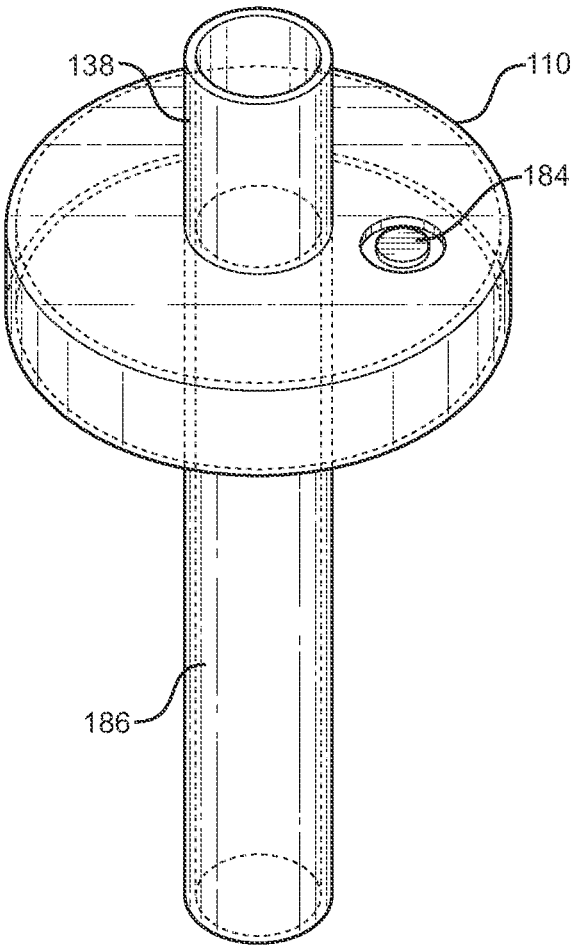
FIG. 14 is a perspective view of a lid having a straw.
Figure 15:
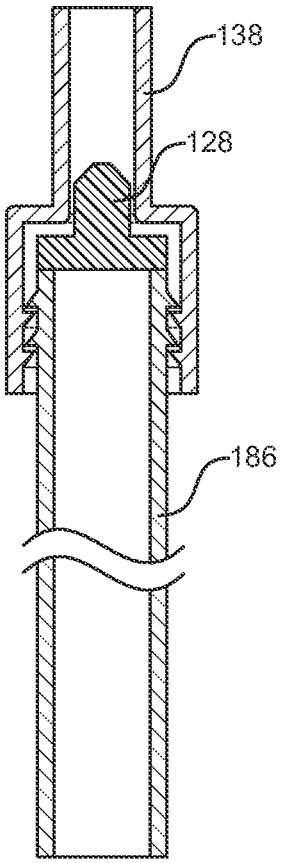
FIG. 15 is a side elevation view of an alterative embodiment of a straw having an internal valve.

FIG. 14 shows an alternative embodiment of a lid 110 having a straw 186. The lid 110 is formed as a single unit and includes the retention ring such that it may be connected to the container. The straw 186 extends into the container and into the liner. FIG. 15 shows an alternative embodiment of a straw 186 that mates together with a spout tip 138 to sandwich a one-way valve 128 therebetween. The straw 186 and spout tip 138 may be removably connected together using a screw-type connection. Alternatively, the two halves may be connected with a snap connection.

The foregoing description of preferred embodiments for this disclosure has been presented for purposes of illustration and description. It is not intended to be exhaustive or to limit the disclosure to the precise form disclosed. Obvious modifications or variations are possible in light of the above teachings. The embodiments are chosen and described in an effort to provide the best illustrations of the principles of the disclosure and its practical application, and to thereby enable one of ordinary skill in the art to utilize the disclosure in various embodiments and with various modifications as are suited to the particular use contemplated.

What is claimed is:

1. A bottle feeding system comprising:

a rigid container having an upper opening defined by an upper rim for providing access to an interior of the container;

a food grade bottle liner having a container portion configured for insertion in to the interior and a lip portion configured to engage the upper rim; and a food spout having an enlarged outlet sized for semi-solid food and having:

a one-way valve having a lower ring portion that surrounds a plurality of flaps that form an opening and are configured to move between an open position and a closed position;

a first lid portion removably engaging a top surface of the lower ring portion and having a first orifice in concentric alignment with the valve opening, wherein the flaps extend through the first orifice;

a retainer ring having an inwardly extending retainer portion configured to directly contact with the first lid portion;

a first clamping member disposed on the retainer ring;

a second clamping member disposed on the container configured to mate with the first clamping member for clamping together the container, bottle liner and the spout.

2. The system of claim 1, wherein the spout further comprises a second lid portion that is configured to contact a bottom surface of the first lid portion and a bottom surface of the lower ring portion, such that the valve is sandwiched between the first and second lid portions, the second lid portion further comprising a second orifice in concentric alignment with the valve opening.

3. The system of claim 2 wherein the second orifice is disposed in an indentation that is sized to receive the valve and is configured such that the top surface of the lower ring portion is flush with a top surface of the second lid portion.

4. The system of claim 1 wherein the first orifice is larger than the valve opening.

5. The system of claim 1, the spout further comprising an elongate tube section extending upwards from the first orifice of the first lid portion, the tube section sized and configured for insertion into a mouth of a user.

6. The system of claim 1 further comprising an elongated section formed between the lower ring portion of the one-way valve and the plurality of flaps of the one-way valve, the elongated section sized and configured for insertion into a mouth of a user.

7. The system of claim 1 further comprising a liner spreader configured for removable insertion into at least a portion to liner to assist in spreading the liner near the upper opening, the liner spreader comprising a rigid cylindrical tube section having an open top and an open bottom, and a lip configured to engage the upper rim of the container and the liner.

8. The system of claim 1 wherein at least a first section of the container portion of the liner has a first wall thickness and wherein at least a second section of the container portion of the liner has a second wall thickness.

9. The system of claim 1 wherein the liner is prefilled with a quantity of liquid or semi solids and has a removable seal disposed over the lip portion.

* * * * *